US005193605A

United States Patent [19]

Divecha et al.

[11] Patent Number: 5,193,605

[45] Date of Patent: Mar. 16, 1993

[54] TECHNIQUES FOR PREPARATION OF INGOT METALLURGICAL DISCONTINUOUS COMPOSITES

[75] Inventors: Amarnath P. Divecha, Falls Church; Subhash D. Karmarkar, Great Falls; William A. Ferrando, Arlington, all of Va.; Scott M. Hoover, Burtonsville; James M. Kerr, Bethesda, both of Md.

[73] Assignee: The United States of America as represented by the Secretary of the Navy, Washington, D.C.

[21] Appl. No.: 787,807

[22] Filed: Nov. 4, 1991

[51] Int. Cl.[5] ..... B22D 19/14

[52] U.S. Cl. ..... 164/97; 164/100; 164/900

[58] Field of Search ..... 164/97, 95, 91, 98, 164/100, 900

[56] References Cited

U.S. PATENT DOCUMENTS 5,000,247 3/1991 Burke ..... 164/97

*Primary Examiner*—Richard K. Seidel
*Assistant Examiner*—Erik R. Puknys
*Attorney, Agent, or Firm*—Kenneth E. Walden

[57] ABSTRACT

Process for the production of ingots of castable discontinuous metal matrix composites by encapsulating particulate refractory material of the $B_4C$ or SiC in a matrix metal of Li or al to form a solid master alloy, and introducing the master alloy into molten Mg or an alloy thereof, mixing and then cooling to solidify the resultant mixture and form an ingot with the refractory material substantially dispersed in the ingot.

9 Claims, 2 Drawing Sheets

TECHNIQUES FOR PREPARATION OF INGOT METALLURGICAL DISCONTINUOUS COMPOSITES

BACKGROUND OF THE INVENTION

1. Field of the Invention

This invention relates in general to a process for the production of discontinuous metal matrix composites and, more particularly, to a process for production of Ingot-metallurgy discontinuous compounds of $B_4C$/Al-Li,$B_4C$/Al, SiC/Al, SiC/Mg, etc.

2. Description of Related Art

Discontinuous matrix metal composites (MMCs) such as SiC whisker and particulate composites are prepared via powder metallurgy (PM). Typically the powders of the composite components such as aluminum and the SiC in desired concentration are mixed intimately. Numerous techniques for mixing are used. Blending in a V blender, in a paint shaker, in a polymeric vehicle, liquid medium (e.g. alcohol or benzene), etc. can be used. Almost invariably, however, the mixture is poor, i.e., the distribution of the two components is not even. This is simply due to the differences in the specific gravity, the particle size and shape of the matrix metal powder and the SiC powder, the particle size distribution and the volume of each component. For example, SiC density is 3.12 g/cc as compared to 2.7 g/cc for Al. The volume fraction of SiC used in a typical composite is 0.20, the rest being Al or its alloy. The average particle diameter (APD) of Al powder is 15 microns (or −325 mesh). The SiC particle APD is 5 microns. The shape or the morphology of Al and SiC are necessarily different because each is prepared by a different method; Al powder is manufactured via atomization while SiC is obtained from the reaction of silica and carbon followed by comminution (as in ball milling) to break down the large chunks.

After a mixture of the two components is obtained, it is necessary to compact them via cold and hot pressing in a die. Since Al powder is always surrounded by a thin layer of its oxide, namely $Al_2O_3$, the compacting must be done under pressure to break the oxide film and generate new fresh Al surface to bond to itself and the SiC. Often, the hot pressing must be done in vacuum to get good compacting and to remove any water of hydration that may exist on the Al powder surfaces. If the outgassing of the water of hydration is incomplete, there is a strong probability of forming hydrogen when the composite billet is heated for secondary forming such as extrusion, rolling, or welding, as the case may be.

While the example cited above is for SiC/Al composite, it is also true of other MMCs such as SiC/Mg and $B_4C$/Mg composites produced via powder metallurgy. In fact, the affinity of finely divided Mg towards $O_2$ is even greater than that of Al. This is due to the differences in the nature of the oxides that form on Al and Mg. Aluminum oxide $Al_2O_3$ is adherent to the underlying Al, but the magnesium oxide (MgO) on Mg is porous. Thus, the oxidation protection provided by $Al_2O_3$ is far superior to that of the MgO. During compaction of the composite, further severe oxidation occurs and the MgO content rises to a significant extent.

Based on the above, it is clear that an ingot metallurgy route to preparation of MMCs is needed. There are, of course, many attempts made in the past to utilize ingot metallurgy to produce discontinuous MMCs. Only one successful process is known, but that process is limited to a casting alloy of Al, A356, which contains 6% Si. This process apparently involves a treatment of SiC particles, about microns in diameter, so that the latter is easily introduced into molten Al alloy A356. Most of the procedure is proprietary and no more than 15 volume percent of SiC can be incorporated into the melt. More desirable matrix alloys such as 6061, 7075, and 2024 are not available. To prepare composites from these alloys, powder metallurgy must be used with attendant problems of oxide contamination, distribution, outgassing, etc., as described above.

U.S. Pat. No. 4,743,511 discloses a cermet particle comprising a continuous ceramic phase and a discontinuous metal phase. U.S. Pat. No. 4,022,584 discloses a composite material of aluminum oxide and refractory transition metal diborides with addition of magnesium oxide. U.S. Pat. No. 4,224,380 discloses bonding a mass of abrasive particles to form an abrasive body. A metallic phase can contain manganese, and alloys of aluminum U.S. Pat. No. 3,725,015 discloses forming a refractory shape by mixing particulate refractory material with a carbon-containing substance, i.e., boron carbide powder mixed with furfuryl alcohol to a desired shape, treating to convert the carbon-containing substance to carbon, and impregnating the structure with a molten metal (silicon, aluminum and boron alloy).

U.S. Pat. No. 3,492,114 discloses metal constituents which are to be alloyed in an alloy or steel melt which are added in the form of an oxide to the lining of the treatment vessel containing the melt so that upon addition of lithium to the melt the lithium replaces the metal constituents of the oxide to free the melt constituents for alloying with the melt. U.S. Pat. No. 4,548,774 discloses a process in which a matrix material is introduced into a fibrous base comprising a spongelike cake form of SiC whiskers. Matrix metals include Mg, Al, Mn, etc. U.S. Pat. No. 3,421,862 discloses a high-strength whisker composite article comprising an alloy matrix which is wetted to single crystal, and non-metallic whiskers (silicon carbide and boron carbide). The matrix can be aluminum or magnesium. A small amount of lithium can be included. The patent discloses intimately mixing powders of the pre-alloy and whiskers and then heating to produce the desired product. Hot pressing, sintering and cold pressing are employed. U.S. Pat. No. 3,999,954 discloses a hard metal body of a bonding metal of iron, cobalt and nickel and a hard metal refractory carbide such as titanium.

U.S. Pat. No. 4,012,204 discloses a composite of polycrystalline alumina fibers in a matrix of an aluminum alloy containing 0.5–5.5% of lithium. U.S. Pat. No. 4,547,435 discloses a composite of a matrix metal (magnesium) and inorganic fibers (silicon carbide fibers, and boron carbide fibers). This patent discloses deterioration of the fibers in contact with the melted metal. There is also mention of using lithium in a small amount in an aluminum matrix. U.S. Pat. No. 4,053,011 discloses a composite of alumina fibers in an aluminum alloy containing small amounts of lithium. Silica coatings on the fibers promote wetting by aluminum-lithium alloys. U.S. Pat. No. 3,890,690 discloses a metal matrix of Al or magnesium and reinforcing members of silicon carbide and boron carbide.

SUMMARY OF THE INVENTION

A process is provided for the production of ingots of castable, discontinuous metal matrix composites comprising encapsulating particulate refractory material in a matrix metal to form a solid master alloy, and introducing the solid master alloy into another metal or alloy which is above its melting point, mixing, and then cooling to solidify the resultant mixture and form an ingot with the refractory material substantially dispersed in the ingot. This process can be used to form an ingot of Mg-Li containing particulate refractory material of $B_4C$ or SiC.

DESCRIPTION OF THE PREFERRED EMBODIMENTS

Figure 1:
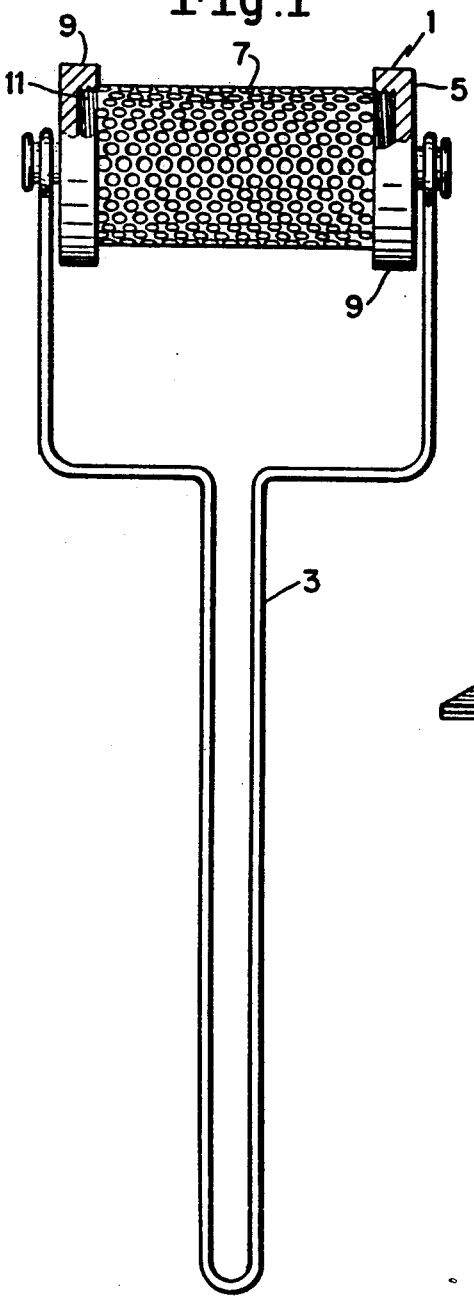
FIG. 1 is a front view of a spreader assembly for application and spreading of particulate refractory material on a sheet of matrix metal.

The process of forming the sandwich of encapsulated particles is illustrated in FIGS. 1 and 2*a–d*. FIG. 1 illustrates a spreader assembly indicated generally at 1 which can be used to apply and spread particulate refractory material on to a sheet of Li or Al. The spreader assembly 1 comprises a handle 3 for a roller assembly 5. The roller assembly comprises a perforate cylindrical center portion 7 having disc shaped end caps 9 secured to both ends thereof. The center portion 7 has perforations slightly larger than the particulate material (not shown) to be applied and spread, FIG. 1. The end caps can have threads 11 into which can be screwed the center portion 7.

Figure 2A:
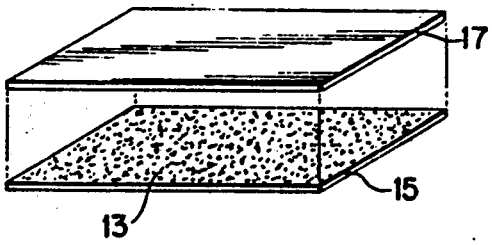
FIG. 2*a* is a perspective view of the formation of a sandwich of sheets of matrix material with particulate refractory material therebetween.
Figure 2B:
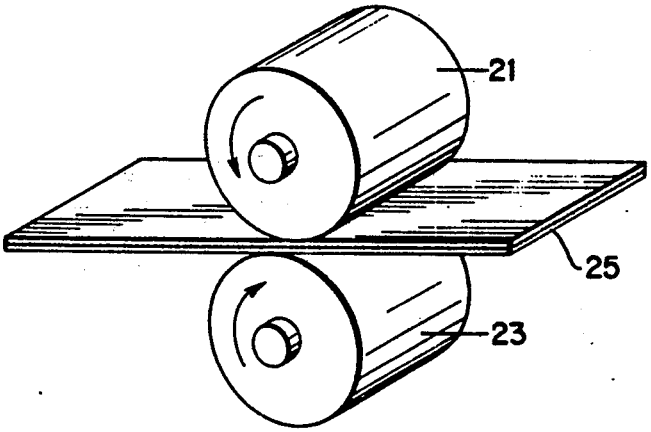
FIG. 2*b* is a perspective view showing rolling of the sandwich of FIG. 2*a* to form a master alloy.
Figure 2D:
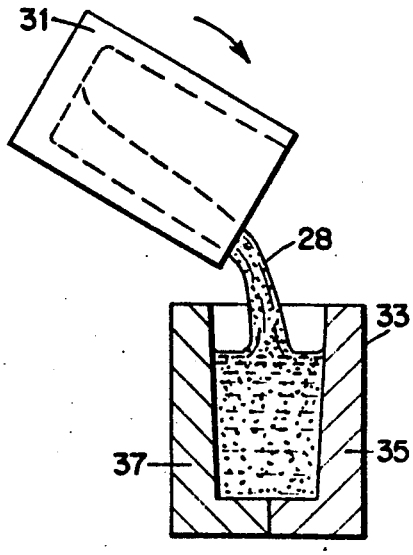
FIG. 2*d* is a sectional view showing casting of the molten mixture from FIG. 2*c* into a book mold to form a composite ingot of the present invention.

The spreader assembly 1 can be used to spread particulate materials such as $B_4C$ or SiC onto a sheet or foil 15 of Li or Al, FIG. 2*a*. Another sheet of Li or Al 17 is shown spaced from the sheet 15. In practice, the sheets 15 and 17 are compacted such as by rolling (FIG. 2*b*) between a pair of rollers 21, 23. The resultant sandwich can be repeatedly rolled between a pair of rollers 21, 23. The resultant sandwich 25 discharging from the rolls contains the particulate refractory material completely encapsulated between sheets 15 and 17. It is preferred to repeatedly roll and fold the sandwich 25 to insure complete encapsulation and uniform distribution of the particular refractory material.

When the sheet 15 or 17 is lithium, it is preferred that the encapsulation procedure be conducted in a dry room at room temperature due to the reactive nature of Li with water vapor.

Figure 2C:
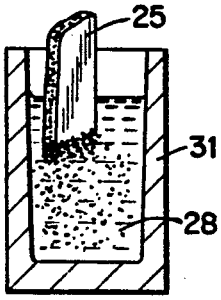
FIG. 2*c* is a side view in cross-section showing the addition and dissolution of the master alloy from FIG. 2*b* into molten Mg or Li or alloy thereof.

The resultant master alloy 25 can then be added in a desired amount to a melt 28 of Mg or Li contained in a vessel 31, FIG. 2*c*. The melt 28 can then be cast to form an ingot such as by pouring same into a book mold shown generally at 33 having sections 35 and 37 FIG. 2*d*. The cast ingot is then cooled and removed from mold 33.

A Mg-9 %Li alloy matrix with 15 volume percent of $B_4C$ particles can be prepared by rolling $B_4C$ particles between sheets of Li and then adding the resultant master alloy to molten Mg. Advantage is taken of the very low density of Li (0.534 g/cc) as compared to that of Mg (1.74 g/cc). Because of the large difference in the density, 9 wt % Li (with the balance being Mg) constituted approximately 20 percent by volume of the alloy. Besides its low density, Li is also extremely soft and ductile. It does not work harden even after extensive plastic deformation because its recrystallization temperature is below room temperature. In this respect it resembles lead and behaves like a superplastic metal. This invention is based on the remarkable ductility of Li and its low density. As shown below, it has been demonstrated that a large amount of particulate material such as $B_4C$ as in this example (or SiC) may be incorporated in a predetermined amount of Li to form a solid master alloy which can be then added to molten magnesium to enable casting of an IM $B_4C$/Mg-9wt % Li composite. (FIG. 2*a–d*).

EXAMPLE 1

28.4 gms of pure Li was weighed. The Li was in the form of half-inch rod. The rod was rolled to a thickness of ⅛" in a rolling mill in a dry room with less than 1.5% moisture. The affinity of Li dictated that the moisture content be low to prevent reaction of Li with atmospheric water.

$B_4C$ powder was then sprinkled on the sheet as evenly as possible using the special spreader shown in FIG. 1, to cover its surface substantially. The sheet was then folded and rolled (FIGS. 2*a, b*) to encapsulate the B4C as in a sandwich. The process was repeated several times until all of the $B_4C$ in . 25 the foil was sufficient to prepare a 15 volume percent $B_4C$/Mg-9 wt % Li ingot.

Figure 3:
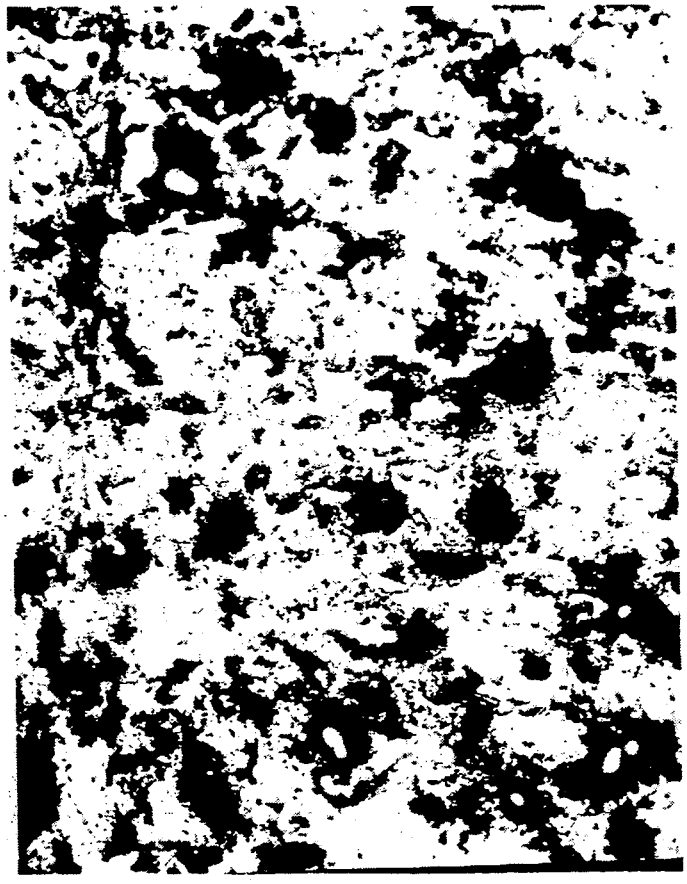
FIG. 3 is a photomicrograph of a cast ingot of $B_4C$/Mg-Li cast according to the present invention.

The solid master alloy of $B_4C$ containing Li sandwich was then utilized to make a composite ingot as follows: 1. Appropriate amount of pure Mg was heated to slightly above its melting temperature in an inert atmosphere in a glove box. The master alloy was then added to molten magnesium, quickly but thoroughly stirred, and poured into a brass book mold. Although in this experiment, the entire master alloy was not dissolved in Mg, the microstructure of the composite showed $B_4C$ dispersed in the matrix (FIG. 3).

EXAMPLE 2

Pure Al foil or sheet of appropriate thickness is used in place of Li. Since the recrystallization temperature of Al is much higher than Li (250° C.), intermediate annealing of the master alloy is preferred after a certain number of passes, depending upon rate of deformation. There are several advantages not available in the case of Li. For example, in any structural alloy, the lithium content will always be small. 2090 Al alloy has only 2% by weight (or 10 percent by volume). Even in Mg-9% Li the lithium volume is 27 percent. While rolling of Li must be done in a dry room, Al is rolled in ambient conditions. If the work hardening is encountered in Al during the encapsulation and rolling, annealing for a short time in a vacuum oven 10 minutes at 300° C. removes cold work and restores full ductility to continue encapsulation (via rolling). Finally, the large volume of Al due to high percentage of it in a given alloy provides greater latitude in encapsulation in the presence of $B_4C$ (and SiC) as well.

EXAMPLE 3

12.42 gms of pure Li was weighed. The Li was in the form of half-inch rod. The rod was rolled to a thickness of ⅛" thick in a rolling mill in a dry room with less than 1.5% moisture or humidity. The affinity of Li dictated that the moisture content be low to prevent reaction of Li with atmospheric water.

$B_4C$ powder (38 gms) was then sprinkled on the sheet as evenly as possible to cover its surface substantially. The sheet was then folded and rolled (FIG. 2*a, b*) to encapsulate the $B_4C$ as in a sandwich. The process was repeated twelve times until all the $B_4C$ was encapsulated. 38 gms of $B_4C$ was encapsulated in 12.42 gms of Li. At this stage, the amount of $B_4C$ in the foil was sufficient to prepare a 15 volume percent $B_4C$/Mg-9 wt % Li ingot. The 'master alloy' of Li/$B_4C$ was measured to be 4"×4"×1/4".

Numerous other modifications and variations of the present invention are possible in light of the foregoing teachings. It is therefore to be understood that within the scope of the appended claims the invention may be practiced otherwise than as specifically described.

What is claimed is:

1. A process for the production of ingots of discontinuous metal matrix composites comprising:

(a) encapsulating particulate refractory material selected from the group consisting of SiC and $B_4C$, by rolling the refractory particulate material between sheets of a matrix metal selected from the group consisting of Li and Al to form a solid master alloy, (b) introducing the solid master alloy into another metal or alloy which is slightly above its melting point, mixing, and then cooling to solidify the resultant mixture and form an ingot with the refractory material uniformly dispersed in the ingot.

2. The process of claim 1, wherein refractory particles of $B_4C$ constitutes about 15 vol. percent of the final ingot, said refractory particles being encapsulated by rolling between sheets of Li to form a master alloy.

3. The process of claim 2, wherein the master alloy is mixed with molten magnesium to form an ingot containing about 9 wt. percent of Li.

4. The process of claim 1, further comprising placing particulate refractory material of $B_4C$ uniformly on a sheet of Li, folding the sheet and rolling the folded sheet to encapsulate the $B_4C$ particles, thereby forming a master alloy.

5. The process of claim 4, further comprising heating pure Mg slightly above is melting point in an inert atmosphere and mixing therein the master alloy, and cooling to form an ingot with the $B_4C$ uniformly dispersed through the ingot.

6. The process of claim 1, further comprising placing the particulate refractory material of SiC uniformly on a sheet of Li, folding the sheet, and rolling the folded sheet to encapsulate the SiC particles, thereby forming the master alloy.

7. The process of claim 6, further comprising heating pure Mg slightly above its melting point in an inert atmosphere and mixing therein the master alloy, and cooling to form an ingot with the SiC uniformly dispersed throughout the ingot.

8. The process of claim 1, wherein the Al is in the form of a foil or thin sheet into which is rolled the particulate refractory material to form a master alloy.

9. The process of claim 8, wherein the rolled master alloy is annealed before being mixed with another metal or alloy.

* * * * *